US005133534A

United States Patent [19]

Gortan et al.

[11] Patent Number: 5,133,534

[45] Date of Patent: Jul. 28, 1992

[54] DEVICE FOR REMOVING WORN NOZZLE BRICKS OR NOZZLE LININGS FROM METALLURGICAL VESSELS

[75] Inventors: Dieter Gortan, Leoben; Erwin Garger, Kapfenberg; Peter Pacnik, Leoben; Josef Mocivnik, Judenburg; Werner Schantl, Mitterdorf, all of Austria

[73] Assignees: Bohler Pneumatic International GmbH, Kapfenberg; Veitscher Magnesitwerke-Actien-Gesellschaft, Vienna, both of Austria

[21] Appl. No.: 659,291

[22] PCT Filed: Jun. 8, 1990

[86] PCT No.: PCT/AT90/00058

§ 371 Date: Apr. 2, 1991

§ 102(e) Date: Apr. 2, 1991

[87] PCT Pub. No.: WO90/15161

PCT Pub. Date: Dec. 13, 1990

[30] Foreign Application Priority Data

Jun. 9, 1989 [AT] Austria ..... 1427/89

[51] Int. Cl.[5] ..... C21C 5/48

[52] U.S. Cl. ..... 266/271; 266/287

[58] Field of Search ..... 266/236, 271, 45, 287, 266/272, 269

[56] References Cited

U.S. PATENT DOCUMENTS 4,222,505 9/1980 Daussan et al. ..... 222/600
4,381,102 4/1983 King ..... 222/607

FOREIGN PATENT DOCUMENTS 3225093 1/1983 Fed. Rep. of Germany .

*Primary Examiner*—Scott Kastler
*Attorney, Agent, or Firm*—Cushman, Darby & Cushman

[57] ABSTRACT

A device for removing worn nozzle bricks or nozzle linings from the tap holes of metallurgical vessels including a spreading device, which can be introduced into the nozzle brick or tap hole, and a drive for extracting the nozzle brick or lining by means of the spreading device. The spreading device is arranged on a tool holder which can be displaced axially on a support, in particular a carriage. The tool holder can be connected to at least one drive. The tool holder advantageously includes an axial cavity in which a toothed shaft is rotatably mounted. The toothed shaft meshes with the toothing of at least two, and preferably three, spreading jaws which slide radially in the tool holder.

10 Claims, 6 Drawing Sheets

DEVICE FOR REMOVING WORN NOZZLE BRICKS OR NOZZLE LININGS FROM METALLURGICAL VESSELS

The invention relates to an arrangement for the removal of worn nozzle bricks or linings in tap holes of metallurgical vessels, comprising an expander unit, which can be introduced into the nozzle brick or into the tap hole, and a drive means to pull away the nozzle brick or the lining by means of the expander unit.

For the dismounting of nozzle bricks which are mounted in the tap holes of metallurgical vessels, it has already become known, for example in AT Patent 386 422, to support an apparatus on the outer side of the metallurgical vessel, to which apparatus is connected an extracting means which extends in the axial direction of the nozzle brick and is longitudinally adjustable in this axial direction by means of a telescopic pressure-medium cylinder. The extracting means of this known arrangement has at least two clamping jaws which can be brought into engagement with, or to disengage from the nozzle brick by means of an expander unit, and this known arrangement is intended to remove nozzle bricks without damaging the permanent lining of the metallurgical vessel. In this regard, the known arrangement must first be brought into the correct position by hand and secured in position on the outer side of the hot metallurgical vessel, the handling being complicated in so far as the arrangement, together with the hot nozzle brick, must be removed manually when the nozzle brick has actually been loosened. It has been found, in many cases, that nozzle bricks cannot readily be pulled out of their position by simple application of pressure or application of tensile force in the axial direction, without damaging the permanent lining. An arrangement for the extraction of a gas-fluxing brick from a nozzle brick has become known from AT Patent 383 831, which took into consideration the fact that a simple axial pull is not, as such, suitable for the reliable loosening of the nozzle brick. In the case of this known arrangement, which must likewise be connected by hand to the gas-fluxing brick, a sliding member is provided which is pushed with considerable force against a buffer, whereby the resultant mass moment of inertia produces an action force which extends in the longitudinal direction of the guide bricks and which pulls the gas-fluxing brick out of the nozzle brick. The extraction forces are, therefore, brought to bear abruptly, it being necessary, in this case, too, to place the arrangement in position by hand against the gas-fluxing brick to be removed. The support is, again, provided on the outer side of the hot metallurgical vessel so as to keep the interruption of operations to a minimum.

It is only gas-fluxing bricks, and not the nozzle brick itself, which are pulled away using the arrangement which has become known from AT Patent 383 831. Nozzle bricks are used, primarily, in tap holes, for example of converters, and the wear of such nozzle bricks results from the contact with the liquid metal during pouring. The region of the tap hole is, therefore, usually provided with a two-layer nozzle brick lining, those nozzle brick members, which are in each case to be replaced, being connected via binding agents to the permanent lining, i.e. the second nozzle brick lining which remains in the metallurgical vessel for a longer period of time. Such nozzle bricks, which are connected to the permanent lining by binding agents, in particular scoured nozzle bricks, must, as a rule, be chiselled out by means of pneumatic air hammers or drilled out by means of drilling appliances. Hydraulic pulling appliances, such as are disclosed, for example, in AT Patent 386 422, can usually only be regarded as being successful when clamping jaws engage the nozzle brick from within and behind, in order to ensure adequate tensile force; it is, of course, not always possible, as such, to preclude the risk of damage to the permanent lining.

The object now of the invention is to provide an arrangement of the kind mentioned at the outset, which, without additional manipulation such as, for example, the erection of a working platform, permits the execution of all working steps which are necessary for the complete replacement of nozzle bricks, including the installation of a new nozzle brick. To meet this object, the arrangement according to the invention essentially includes that the expander unit is arranged on a tool carrier which is displaceable in the axial direction on a support, in particular a carriage, and that the tool carrier can be connected to at least one driving mechanism. As a result of the fact that the expander unit is arranged on a tool carrier which is displaceable in the axial direction on a support, in particular a carriage, a simple positioning means and an adequate working path are provided, as a result, different working steps during the dismounting and installation of nozzle bricks can be carried out by simply exchanging tools on the tool carrier. In this regard, the expander unit can be used both during the pulling-away of the nozzle brick and also for the renewed mounting of a new nozzle brick, it being possible, in addition, to place such tools as appear suitable for the complete clearing of the hole, in position on such an expander unit. Due to the above-mentioned displaceability, it is therefore possible, in addition, to the mere removal of worn nozzle bricks or linings, to also carry out a renewed positioning of new nozzle bricks in the correct position, wherein the displaceability of the tool carrier on a support, in particular a carriage, provides the means to arrange the entire arrangement on a mobile underwagon, as a result of which the manipulation during dismounting and installation of nozzle bricks is substantially simplified. It is, in particular, the securing in position and the support on the hot vessel wall which are dispensed with, since the support or the carriage can be driven into the respective position automotively and the forces of reaction are taken up by a underwagon. The use of a tool carrier also makes it possible to undertake other operations by means of such a tool carrier, such as, in particular, the cooling of the nozzle brick in preparation for its removal. Such cooling of the nozzle brick, in preparation for the removal, leads to internal stresses which promote the pulling-out of the keystone or nozzle brick, and results in the preserving treatment of the extracting tools. The tool carrier, however, also permits, depending on the type of driving mechanism after bracing, an impact-supported pulling-out or hammering-out of nozzle bricks to be achieved. It is also possible to secure drilling tools on such a tool carrier by means of which the opening can be calibrated for the introduction of the new nozzle brick. Finally, a pre-assembled nozzle brick unit can be driven in by the carriage via the tool carrier.

In order to fulfil all these functions, the arrangement according to the invention is advantageously designed such that the tool carrier has an axial hollow space in which a serrated shaft is supported to be rotatable, and that the serrated shaft meshes with a toothing of at least two, preferably three expanding cheeks which are guided to be displaceable in the radial direction in the tool carrier. A rotating tool movement can be achieved via the rotatingly supported serrated shaft, if required for the drilling or calibrating, it being possible directly to use the expanding cheeks to secure the calibrating tools. If, conversely, the tool carrier is secured against a rotating movement and a defined moment of torsion is applied only to the serrated shaft, there results a pressing of the expanding cheeks against the inner wall of the nozzle bricks, when the expanding cheeks are extended, and the tool carrier can be acted upon to hammer in order to promote a detaching of the nozzle brick.

For the purpose of transmitting a rotary movement to the tools for calibrating or drilling of the hole, which tools have been mounted on the expanding cheeks, the design is advantageously such that the tool carrier is supported to rotate in the support or on the carriage, and is locked so as to be irrotational relative to the support or the carriage, whereby this locking mechanism serves to provide the required expanding forces to permit a pulling-out of the brick.

Various drives are, advantageously, connected to the tool carrier and the serrated shaft, in a simple manner, to connect a rotary drive to the serrated shaft, and a percussion drive, in particular a counterblow hammer, to the tool carrier. In this regard, the percussion drive acts on the hollow tool carrier and, therefore, on to a correspondingly rigid tubular structural component, whereas the serrated shaft is used to transmit moments of torsion both for the pressing of the cheeks and also for the rotating drilling of the opening.

For the purpose of cooling the tap hole wall and to obtain shrinkage strains to loosen the worn nozzle brick, the design is, advantageously such that the serrated shaft has at least one axial duct which is connected to nozzles or discharge openings in the vicinity of the free end of the tool carrier and to a connection for a fluid. A corresponding tight seal can be achieved in a simple manner in that the serrated shaft, itself, comprises this axial duct for the supply of a fluid, it being possible to achieve the feeding of the fluid into the axial duct in a particularly simple manner in that the connecting means for the fluid has an annular duct on the support or the carriage, into which annular duct open radial bores to the axial duct of the serrated shaft.

To simplify the assembly and to expand the range of application of the arrangement according to the invention by connecting the most varied tools, the design is advantageously such that the serrated shaft is connected to be rotationally secured to a rotary drive shaft via a toothing, and to be displaceable in the axial direction. In particular when the design is such, as corresponds to a preferred embodiment, the head member of the tool carrier which carries the expanding cheeks is detachably connected via a screw thread to that part of the tool carrier which can be connected to the percussion drive, the head of the tool carrier can be removed in a simple manner from the tool carrier, whereby the serrated shaft can also be removed together with the head, due to the connection of the serrated shaft to a rotary drive shaft, with the result that other tools can be connected to the rotary drive shaft. With regard to such a simple dismantling of the head member, without dismantling the drive or drives, the design is, advantageously, such that the screw thread for the connection of the tool carrier to the head member of the tool carrier has a core diameter which is greater than the outside diameter of the serrated shaft which is connected to the rotary drive shaft, as a result of which all rotationally locking interconnected structural members of the tool carrier and the central drive shaft can be dismantled in a forward direction.

In the arrangement according to the invention, a boring head can also be connected directly to the tool carrier in a particularly simple manner, the design advantageously being such that a sleeve is screw-connected to the screw thread, which sleeve has a round thread or a trapezoidal thread on its outer side, on which a boring head can be screwed against a limit stop of the tool carrier. A sleeve of this kind can be screw-connected to the tool carrier in a simple manner, the outer thread of such a sleeve permitting the simple screw-connection of a boring head using the rotary drive of the tool carrier. In so doing, the screw-connecting of the boring head is provided on the round or trapezoidal thread up to a limit stop of the tool carrier, it being necessary, of course, during the subsequent drilling, that the same direction of rotation is maintained so as to prevent a detaching of the boring head from the thread. Otherwise, a separate rotational securing means relative to the tool carrier would have to be provided in the screw-connected position of the boring head. In order to permit the screw-connecting on to the outer thread of the sleeve, the boring head must be held rotationally secure during screw-connecting, the design advantageously being such that the boring head which can be screwed on to the sleeve has a limit stop for a separate rotational securing means which co-operates with a releasable limit stop on the support. The separate rotational securing means must, of course, be released again for the subsequent drilling operation.

BRIEF DESCRIPTION OF THE DRAWINGS

The invention is described hereinafter in more detail with reference to an exemplified embodiment which is diagrammatically illustrated in the drawing. In the drawings -

FIGS. 4 and 5 show cross-sections along the line IV—IV of FIG. 3 of an expanding cheek, wherein FIG. 4 shows the retracted position and FIG. 5 the extended position of the expanding cheeks;

In FIG. 1, reference number 1 designates an underwagon which is displaceable on a caterpillar-type vehicle 2, a support or a carriage 8 being secured in position on an arm 5 which can be raised and lowered and aligned via cylinder/piston units 3 and 4. Secured in position on this support or carriage is a tool carrier, which is illustrated in more detail in the subsequent FIGS. and which is displaceable in the direction of the two-way arrow 7 by a cylinder/piston unit 6, as well as a percussion tool which is designed to be a counterblow hammer 10 which exerts a striking movement on the tool carrier 9, which movement is designed by the two-way arrow 11.

Figure 1:
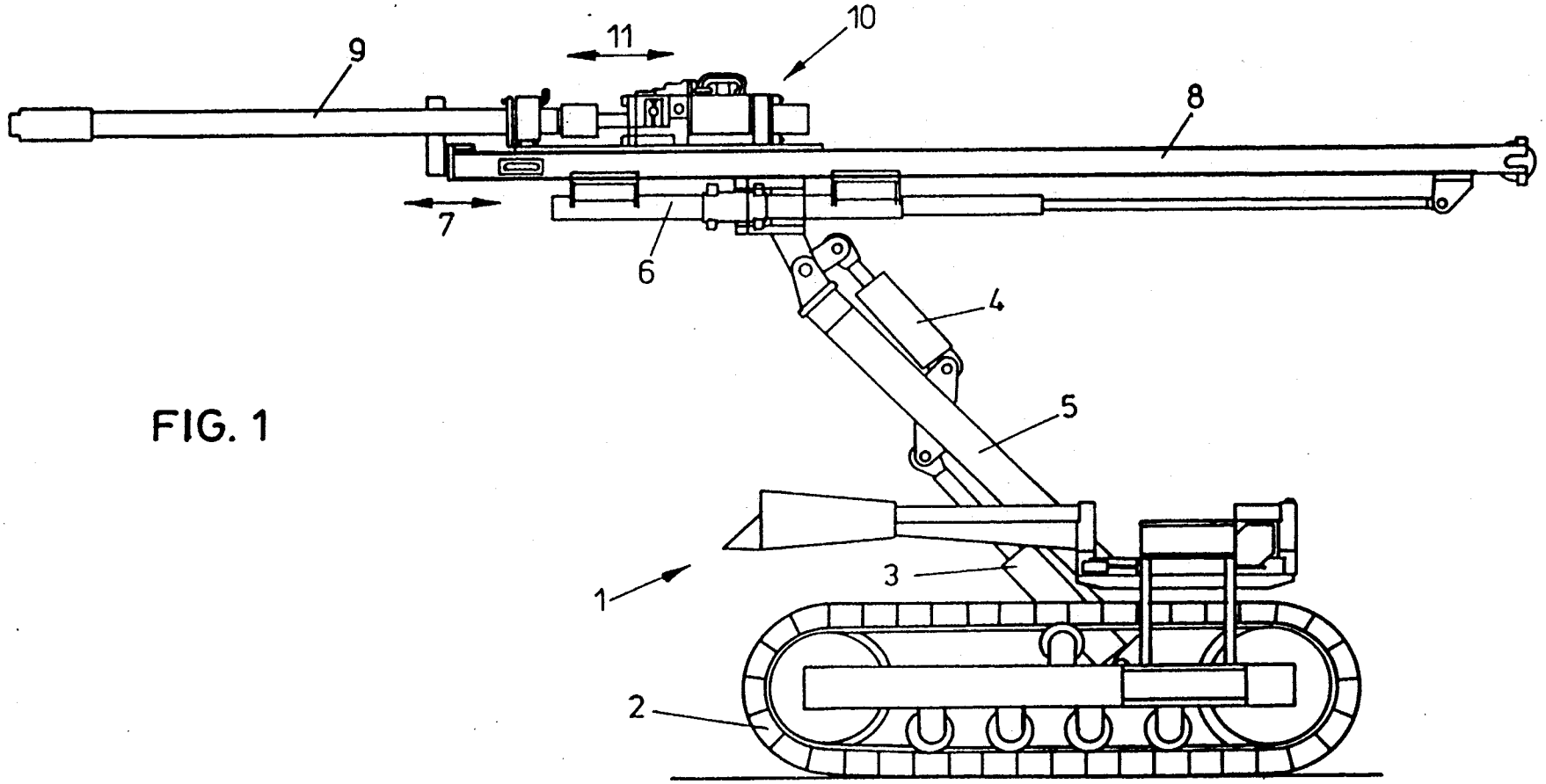
FIG. 1 shows a lateral view of an arrangement according to the invention which is secured in position on a displaceable underwagon.

Using the displaceable underwagon, the tool carrier can be placed in position for the dismounting, the removal and the installation of nozzle bricks or tap holes of metallurgical vessels according to the requirements regarding a tap hole of a converter which is not shown in any detail, and the removal of a worn nozzle brick or a worn lining, as well as a calibration and a subsequent mounting of a new lining can be carried out without manual handling of an extracting means which must be secured in position directly on the metallurgical vessel. It is thus possible, using a single arrangement such as is illustrated in FIG. 1, and with a minimum of operational input, to service a large number of tap holes, even on different converters, and it is unnecessary to provide corresponding holding means and extracting means in the region of each tap hole. In the section of the tool carrier illustrated in FIG. 2, it can be seen clearly that a serrated shaft 13 and a rotary drive shaft 14, which is connected to the serrated shaft 13 so as to be rotationally secured, is supported in a hollow space 12 which extends in the axial direction of the tool carrier 9. Instead of the drive shaft, which has thus been divided into two parts and which is illustrated in more detail in FIG. 3, it is, of course, possible to use a continuous shaft, although the divided design entails advantages in connection with the assembly of the overall tool carrier, as will be described in more detail hereinafter. Both the serrated shaft 13 and the rotary drive shaft 14 have a duct 15, which extends in the axial direction and which opens up into nozzles or discharge openings 17, in the region of the head 16 of the tool carrier, and which has, at that end which is opposite the tool carrier head 16, a connection, formed by radial channels 18, to an annular chamber 19 for the supply of a fluid. Also arranged in the region of the head 16 of the tool carrier are expanding cheeks 20 which are displaceable in the radial direction relative to the serrated shaft and, therefore, relative to the entire tool carrier.

The counterblow hammer 10 exerts its striking energy on two half shells 21 in the region of a connecting member 22, the impact stress thus exerted by the counterblow hammer 10 in the direction of the two-way arrow 11 being transmitted, via the transition piece which is screw-connected to the outer pipe 23 of the tool carrier, to said outer pipe. The tool carrier 9 is, thus, centered with its outer pipe in a guide means 24.

The transmission of a moment of torsion to the rotary drive shaft 14 or the serrated shaft 13, is carried out by a drive by means of a rotary drive, which is not illustrated, of a stub 25 in the direction of the arrow 26, wherein the rotation is transmitted via a joining member 27 to the rotary drive shaft 14 and, via corresponding toothing 28, in sequence to the serrated shaft 13 which co-operates with the expanding cheeks 20. The design of the toothing 28 at the connection of the serrated shaft to the rotary drive shaft, and the securing in position of the head 16 of the tool carrier 9 on the outer pipe 23 of the tool carrier is, in this regard, such that the thread 29 for the securing of the head 16 on the pipe 23 has a larger diameter than the outside diameter of the serrated shaft 13 in the region of the toothing 28. To prevent a rotation of the outer pipe 23, as is necessary in the case of certain working steps, a safety mechanism 30 is provided which engages in a perforated disc 31 which is connected to the pipe 23 and which is, for example, provided with regularly spaced openings.

Figure 4:
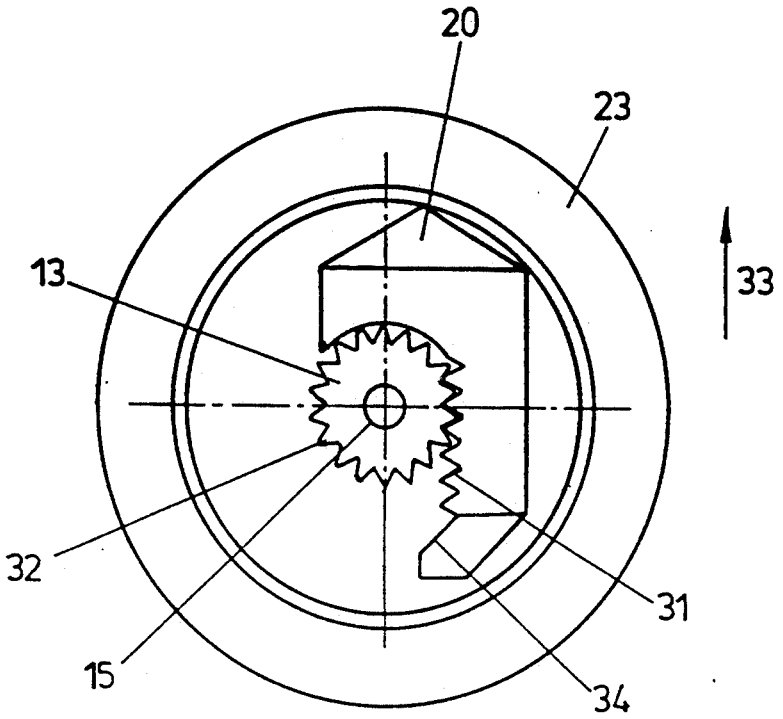
Figure 5:
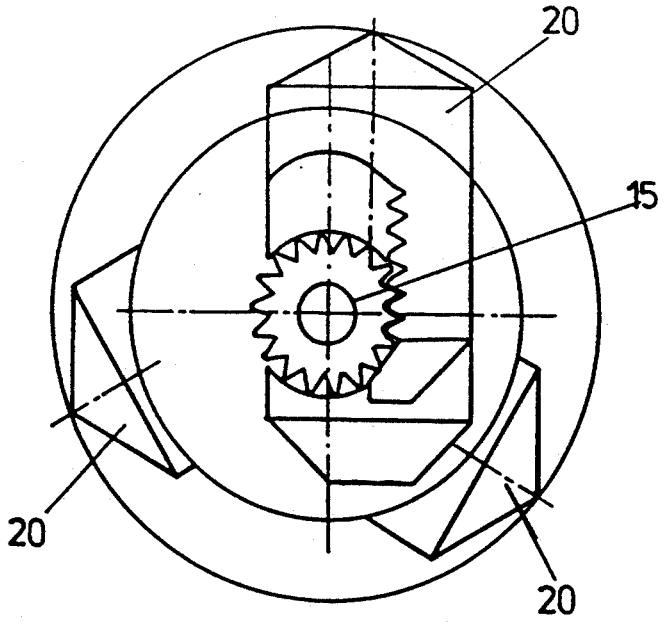

The arrangement and the movement of the expanding cheeks 20 is illustrated in more detail in FIGS. 4 and 5. In this connection, the expanding cheeks 20 mesh, via a toothing 31, with an outer toothing 32 of the serrated shaft 13, such that, during a rotation, the expanding cheeks 20 move out of the position illustrated in FIG. 4, in a radial direction, as indicated by the arrow 33, into the position illustrated in FIG. 5. In this regard, the cheeks are guided in corresponding recesses in the head 16 of the tool carrier, said recesses extending in the radial direction, and have, in each case, a limit stop 34 which, on the one hand, prevent the expanding cheeks 20 from falling out, and which bring about that, during a continued rotation in the position illustrated in FIG. 5 or in the case of abutting of the cheeks against a nozzle brick or a mounted tool, the entire tool carrier is brought into rotation.

For the purpose of removing a nozzle brick or a work lining in a converter opening, the tool carrier 9 is introduced into the opening to be cleared, cooling of the nozzle brick to be removed or of the lining being achieved in preparation for the dismounting and, simultaneously, in protection of the tool carrier, by the supply of a fluid via the nozzles or discharge openings 17 in the foremost portion of the head of the tool carrier. In this regard, the internal stresses produces by the cooling promote the subsequent loosening of the lining to be removed. Subsequent to a corresponding positioning of the tool carrier 9 by displacement thereof in the direction of the arrow 7 relative to the carriage 8, a projection and bracing of the expanding cheeks 20 in the lining takes place as a result of rotation of the serrated shaft 13, whereupon said lining is knocked out by a pulling away which is assisted by the counterblow hammer 10. In so doing, the entire tool carrier which is now spread out in the lining in its head region, together with the counterblow hammer 10 which is producing an impact energy, is pulled out, with removal, of the opening to be cleared by the cylinder/piston unit 6 which is illustrated in FIG. 1.

Figure 6:
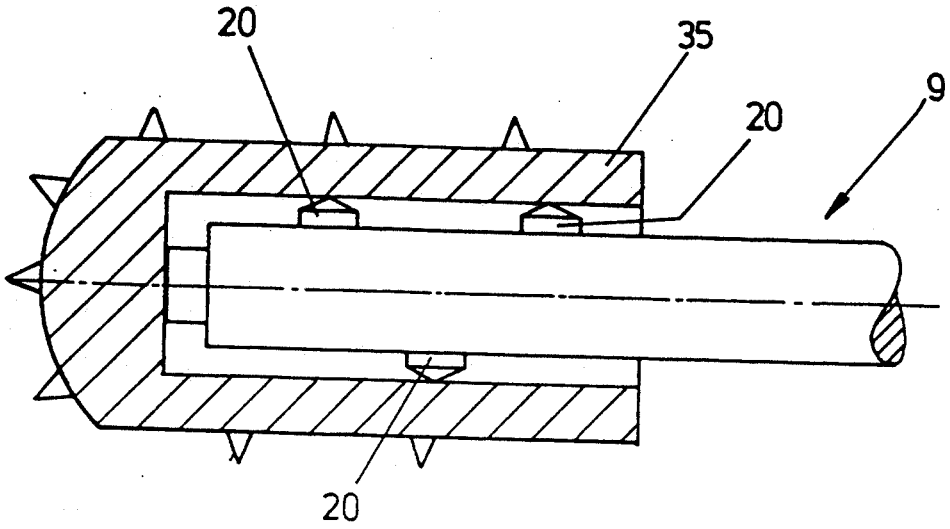
FIG. 6 shows a diagrammatic representation of the securing of a calibrating tool on the arrangement according to the invention.

After a removal of this kind of a worn nozzle brick or a worn lining out of a tap hole to be cleared, parts of the lining generally remain in said tap hole, and the opening is bored open or calibrated prior to mounting of a new nozzle brick or a new lining. This can be carried out in a simple manner using the tool carrier 9 in that a bore crown or a calibrating tool 35, as is diagrammatically illustrated in FIG. 6, is held by the expanding cheeks 20 in the region of the head of the tool carrier 9. As a result of the exercising of a rotation on the tool carrier 9 by driving the serrated shaft 13 and entraining of the outer pipe 23 by the expanding cheeks, a boring out of the tap hole is thus carried out by driving the boring tool 35.

Figure 7:
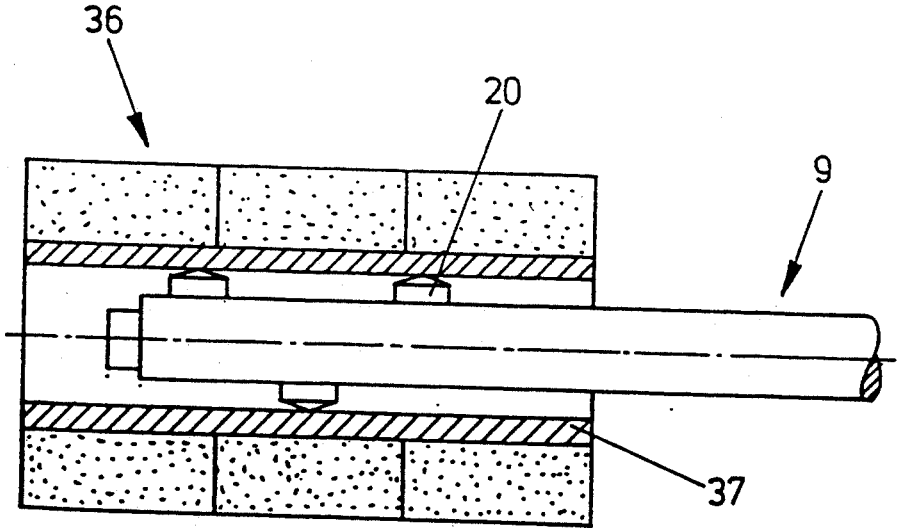
FIG. 7 shows an illustration analogous to FIG. 6 of the securing on the arrangement according to the invention of a nozzle brick unit which is to be newly mounted.

Subsequent to a clearing or calibrating of the opening carried out in this manner, the tool carrier 9 is then used for the mounting of a new nozzle brick unit 36, the procedure being such that the new nozzle brick unit 36, which has, for example, been secured in position on a steel pipe 37, is held by means of the expanding cheeks 20 and is positioned in the tap hole by the corresponding displacing of the entire tool carrier, the securing in position of the new nozzle brick unit being illustrated diagrammatically in FIG. 7.

As a result of the dividing of the drive shaft for the transmission of a moment of torsion or for the rotary drive of the entire tool carrier 9 into a plurality of shaft portions which are interconnected so as to be rotationally secured, and as a result of the separate securing of the head 16 of the tool carrier comprising the expanding cheeks 20 on the pipe 23, the assembly of the entire tool carrier is considerably simplified and, moreover, various designs of the head 16 or of the expanding cheeks can be mounted, in adaption to different tap hole openings. During assembly of the tool carrier 9, the procedure is such that, once the half shells 21 have been placed in position for the transmission of the impact energy, and once the transition piece 27 has been arranged on the stub shaft 25 and the one end of the rotary drive shaft 14, the pipe comprising the connecting member 22 is screw-connected. During mounting of the head 16 of the tool carrier, as a first step the expanding cheeks 20 are inserted into the corresponding recesses in the tool head 16, whereupon the serrated shaft 13 is guided into the central recess of the head 16, as a result of which the expanding cheeks 20 are secured against falling out by the respective limit stops 34. Thereupon, the head 16 comprising the expanding cheeks 20, is pushed into the pipe 23 and there results a rotationally secured connection of the serrated shaft 13 to the rotary drive shaft 14 by means of the toothing 28. The securing in position of the head 16 on the pipe 23 is, in this regard, provided by screwing by means of the thread 29.

As already indicated above, as a result of the modular assembly, it is possible to respond in a simple manner to various diameters of the openings to be cleared, by replacing the head 16 of the tool carrier 9. It is, moreover, possible to replace, rapidly, the individual components of the tool carrier which are interconnected by screw- or plug connections. As a result of the simple construction of the tool carrier 9 in its central portion comprising the pipe 23 and the shaft 14 guided therein in the hollow space 12, a simple adjustment is provided to various nozzle brick lengths, the outside diameter of the pipe 23 being adapted to the smallest possible nozzle brick diameter or diameter of a lining. In addition to the use of different designs of heads 16, allowance can also be made for various diameters of nozzle bricks or lining by the simple replacing of the cheeks 20. It is thus possible to work with a few individual parts, it generally being sufficient for an adjustment merely to replace the head 16 and/or the expanding cheeks 20, while one single tool carrier, the length of which is adapted to the maximum length of an opening to be cleared, is found to be sufficient as a result of the considerable length of displacement or the considerable displacement path of the tool carrier 9 on the carriage 8.

Figure 8:
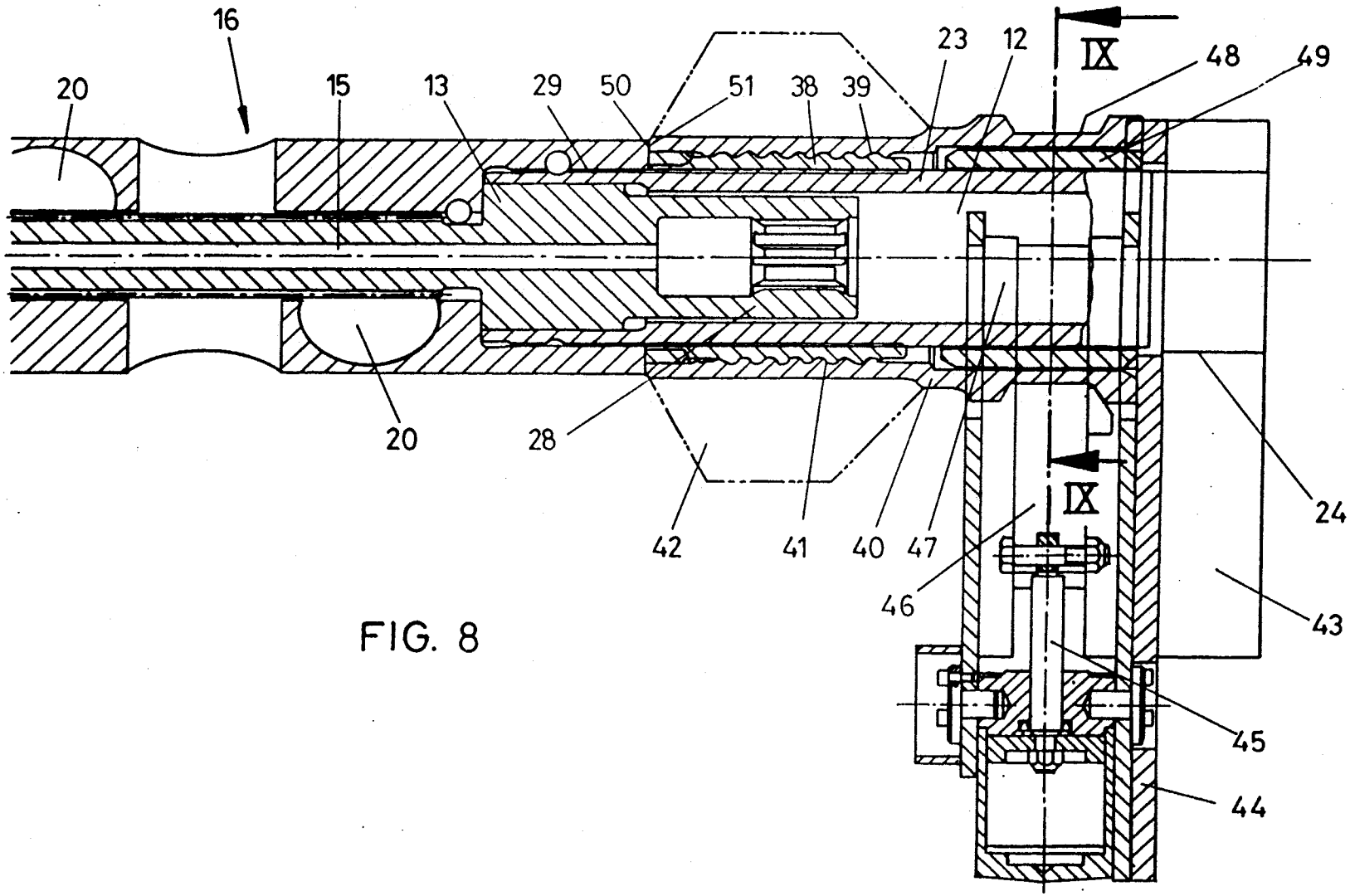
FIG. 8 shows, on an enlarged scale, a partial section of a modified embodiment for the securing of a boring tool on the arrangement according to the invention.
Figure 9:
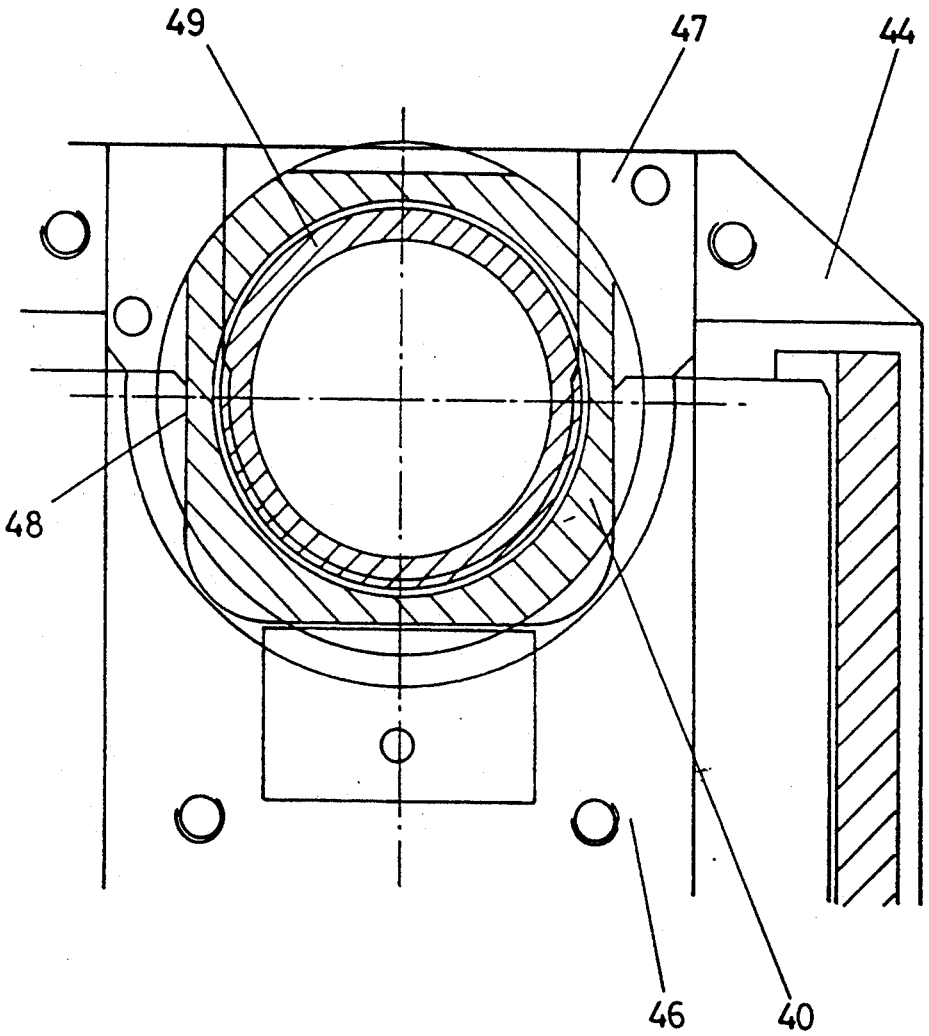
FIG. 9 shows a partial cross-section along line IX-IX of FIG. 8.

Instead of the securing in position of a calibrating or boring tool by the expanding cheeks 20, as is illustrated in FIG. 6, in the embodiment according to FIGS. 8 and 9 in which the reference numbers of the preceding FIGS. have been retained in respect of identical structural members, the screw thread 29 on the pipe 23 for the securing of the head 16 which, in this embodiment, overlaps that free end of the pipe 23 which faces away from the counterblow hammer 10, is designed to be extended and a sleeve 38 is screw-connected to the pipe 23 via the thread 29, which sleeve has a round thread 39 on its outer side. In the position illustrated in FIG. 8 of the entire tool carrier 9, the head comprising the expanding cheeks 20, which are not shown in any detail, is disposed in the vicinity of the guide means 24 through which passes the outer pipe 23 as is shown in more detail, in particular, in FIGS. 2 and 3. In this position, the outer pipe 23 is screwed into a bore head 40 via the sleeve 38, which bore head has, on its inner side, a round thread 41 which co-operates with the round thread 39 of the sleeve 38. The cutting edges of the bore head are diagrammatically indicated by reference number 42. In the neutral position illustrated in FIG. 8, the bore head 40 is supported by a holding means 44 which is directly connected to the support 43 which supports the guide means 24 and is connected to the carriage. In this holding means, a slide 46, which can be actuated by a cylinder 45, secures the bore head 40 in abutment against the support 43 by means of an end member 47 designed to be U-shaped. In so doing, the U-shaped, fork-shaped end region 47 of the slide 46 overlaps a region 48 of the bore head 40, which region is essentially of a square design, and thus secures it against an axial displacement and a rotation. The correct position of the bore crown 40 relative to the support 43 or the holding means 44 is, moreover, ensured by a tubular extension 49 which is rigidly connected to the holding means 44. After screwing of the outer pipe 23 into the bore crown 40 via the sleeve 38, the bore crown 40 is released after a lowering of the cylinder/piston unit 45 and the associated slide 46, and during a rotation of the entire tool carrier 9 via the above-mentioned rotary drive in the same direction as the screw-connecting of the sleeve 38 into the bore crown 40, as a result of the co-driving of the bore crown 40, the means are provided for the boring-out of the bore hole from which the worn lining bricks had previously been removed by means of the expanding cheeks 20. The movement of the entire tool carrier 9 in the axial direction is, again, carried out via the displacement drive of the carriage.

Figure 2:
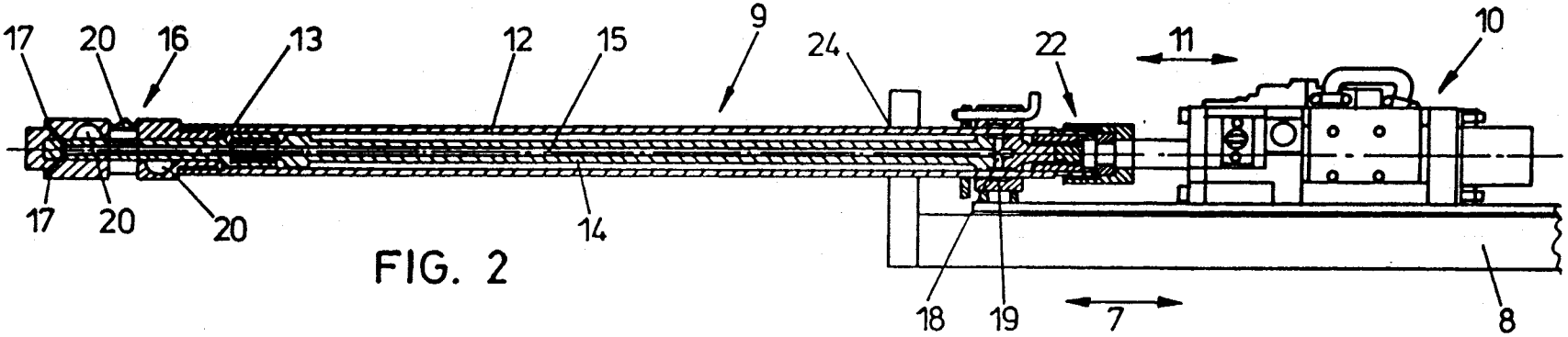
FIG. 2 shows, on an enlarged scale, a section through the tool carrier of the arrangement according to the invention as per FIG. 1.
Figure 3:
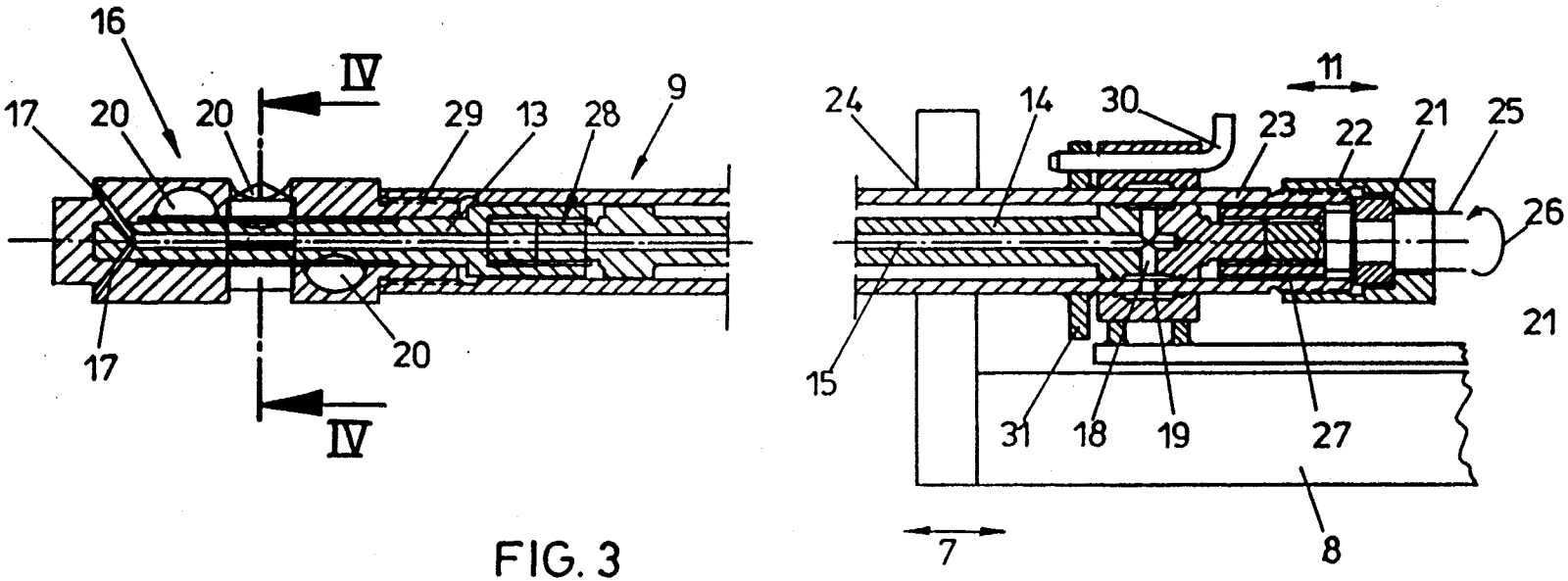
FIG. 3 shows a view similar to FIG. 2, on a still more enlarged scale, of the head and of that end of the tool carrier which faces away from the head.

In the illustration according to FIG. 8, only the head 16 and the front portion 13 of the serrated shaft with the coupling member 28 are shown in detail, wherein the connection of the serrated shaft 13 to the second portion 14 is undertaken via the coupling 28 analogous to the design according to FIGS. 2 and 3.

When the boring operation has been completed, the entire tool carrier 9, together with the bore crown 40 which is secured in position thereon, is again displaced in the axial direction into a position in which the bore crown 40 assumes the position near the support 43 and the holding means 44, as illustrated in FIG. 8. Once the bore crown 40 has been secured in position by the slide 46 and the claws 47 which embrace the bore crown in the region 48, the pipe 23, together with the sleeve 38, is screwingly disconnected from the bore crown 40 by a rotation in the reverse direction, as a result of which the tool carrier 9 together with the head 16 is again completely separated from the boring tool 40. The stop face 50 on the end of the head 16 facing the bore crown and the stop face 51 on the front end of the bore crown 40, which stop faces co-operate with one another, serve to define the screw-connecting movement of the pipe 23 together with the sleeve 38 into the interior of the bore crown 40 and as protection against torsion of the bore crown 40 during boring of the bore hole. Instead of the round thread 39 and 41, correspondingly loadable helical threads, such as, for example, a trapezoidal thread, may be provided.

We claim:

1. A device for the removal of worn nozzle bricks or linings in tap holes of metallurgical vessels, said device having an expander unit which is introduced into the nozzle brick or tap hole and drive means which is operatively related to the expander unit for pulling away the nozzle brick or lining from the vessel, the device further comprising:

a tool carrier within which the expander unit having at least two expanding cheeks is disposed, the tool carrier including an axial hollow space wherein a serrated shaft is rotatably supported, the serrated shaft meshing with toothing of said expanding cheeks, the expanding cheeks being displaceable in the radial direction of the tool carrier in response to the rotation of the serrated shaft to engage the nozzle brick or lining, said tool carrier being displaceable in the axial direction of a support in response to actuation of the drive.

2. A device according to claim 1, wherein the tool carrier is rotatable relative to the support and wherein means are provided for selectively locking the carrier against rotation relative to the support.

3. A device according to claim 1, wherein a rotary drive is connected to the serrated shaft and wherein said drive means comprises a percussion drive operatively related to the tool carrier.

4. A device according to claim 1, wherein the serrated shaft has at least one axial duct which is connected to nozzles near a free end of the tool carrier, and means for supplying a fluid to said duct.

5. A device according to claim 4, wherein the fluid supplying means includes an annular duct on the support which communicates with the axial duct of the serrated shaft.

6. A device according to claim 1, wherein the serrated shaft is connected to a rotary drive shaft via a toothing so as to be rotationally secured to the rotary shaft and displaceable in the axial direction therewith.

7. A device according to claim 3, wherein a head member of the tool carrier which carries the expanding cheeks is detachably connected via a screw thread to a part of the tool carrier connected to the percussion drive.

8. A device according to claim 7, wherein the screw thread has a core diameter which is greater than the outside diameter of the serrated shaft.

9. A device according to claim 7, wherein a sleeve is screwed onto the screw thread, opposite said head member, the sleeve including one of a rounded thread and a trapezoidal thread about the periphery thereof, a bore head being engaged with the threaded periphery of the sleeve, the bore head abutting a limit stop of the tool carrier upon threaded engagement with the sleeve.

10. A device according to claim 9, wherein the bore head has a limit stop providing a separate rotational securing means cooperable with a releasable limit stop on the support.

* * * * *